US005261557A

United States Patent [19]

Bytell et al.

[11] Patent Number: 5,261,557

[45] Date of Patent: Nov. 16, 1993

[54] DECORATIVE WINDOW FOR PAPER AND SOAP PRODUCT DISPENSERS

[75] Inventors: Joseph Bytell, Hartford, Wis.; Jerry A. Sigmund, Wynnewood, Pa.

[73] Assignee: Scott Paper Company, Philadelphia, Pa.

[21] Appl. No.: 959,574

[22] Filed: Oct. 13, 1992

[51] Int. Cl.[5] ..... B65D 8/06

[52] U.S. Cl. ..... 220/662; 206/45.31; 40/611

[58] Field of Search ..... 220/662, 663; 40/611, 40/584; 206/45.31, 45.34

[56] References Cited

U.S. PATENT DOCUMENTS

| | | | |
|---|---|---|---|
| 1,676,621 | 7/1928 | Pittelkow | 220/662 |
| 2,214,030 | 9/1940 | Pereles . | |
| 3,561,146 | 2/1971 | Dembar . | |
| 3,667,648 | 6/1972 | Koziol | 220/662 |
| 4,244,512 | 1/1981 | Wise . | |
| 4,275,518 | 6/1981 | Martin . | |
| 4,291,475 | 9/1981 | Schoemer . | |
| 4,310,976 | 1/1982 | Wilten . | |
| 4,463,851 | 8/1984 | Cecil | 220/45.34 |
| 4,789,073 | 12/1988 | Linz | 220/662 |
| 4,915,316 | 4/1990 | Bastian . | |
| 5,054,616 | 10/1991 | Gelardi et al. | 220/662 |

*Primary Examiner*—Joseph Man-Fu Moy

*Attorney, Agent, or Firm*—Mark G. Bocchetti; John W. Kane, Jr.

[57] ABSTRACT

A decorative window for use with a sanitary product dispenser such as a dispenser for dispensing tissue, paper towels or liquid soap. The window is substantially transparent and is mounted to the front cover of the dispenser. A decorative strip support releasably engages the window from within the dispenser. The decorative strip support member includes at least one flexible latch bar which is engageable with a latch bolt receptacle in the window. A decorative strip cut to the appropriate size can be inserted against the inside surface of the window with the decorative strip support removed. The decorative strip support can be reinserted against the window such that the latch bar engages the latch receptacle thus pressing and supporting the decorative strip between the window and the decorative strip support and automatically compensating for decorative strips of different thicknesses.

18 Claims, 7 Drawing Sheets

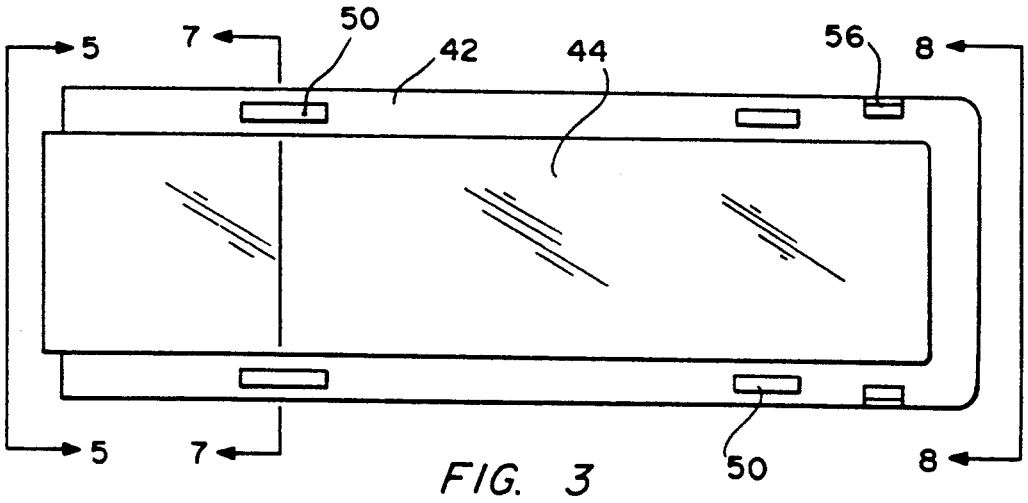
FIG. 3
FIG. 6
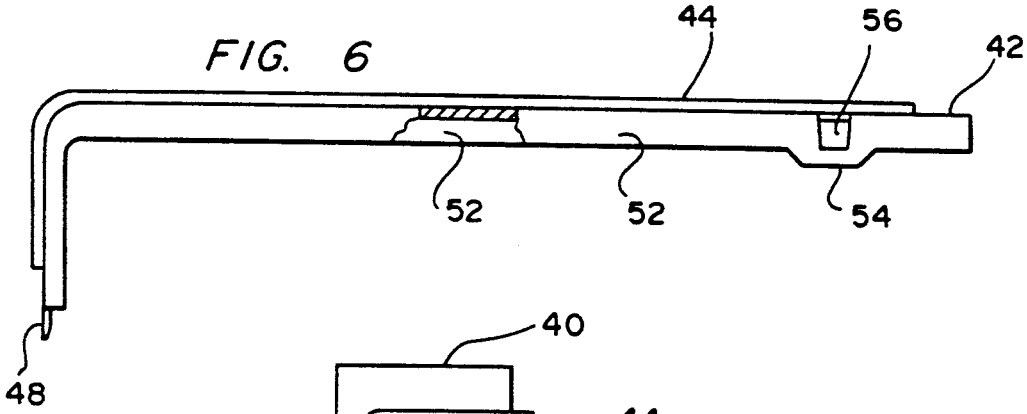
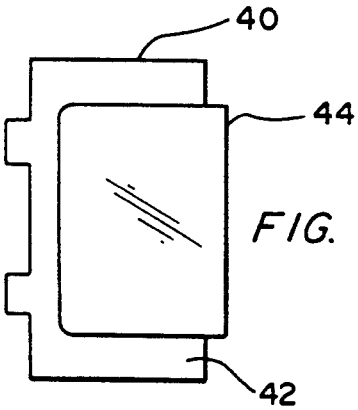
FIG. 5
FIG. 4
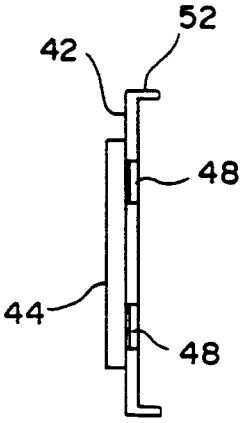
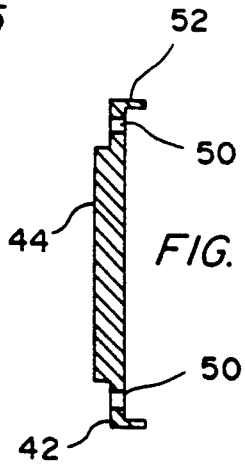
FIG. 7

FIG. 8
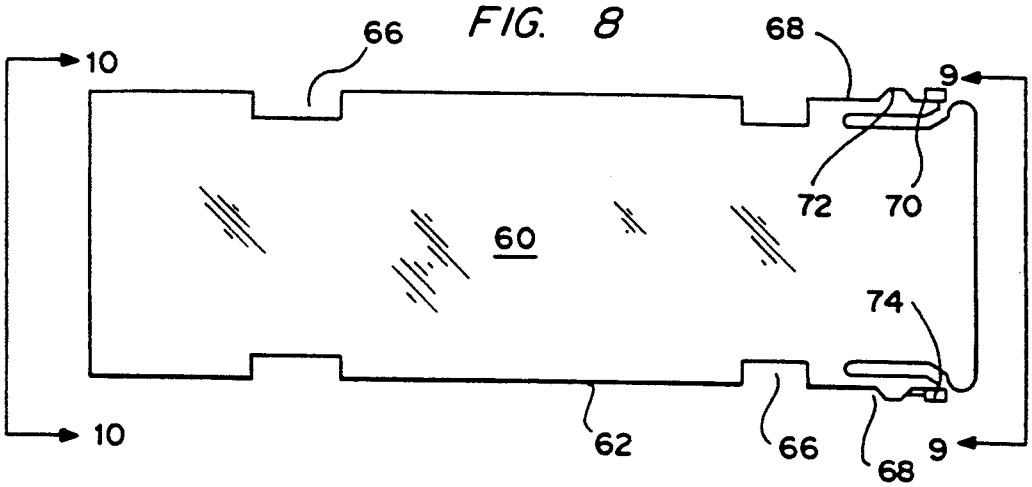
FIG. 9
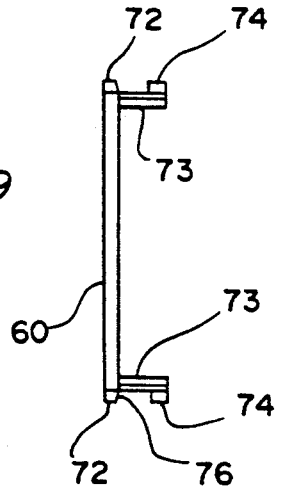
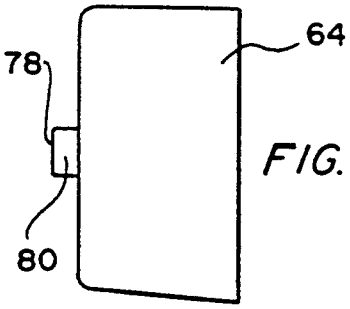
FIG. 10
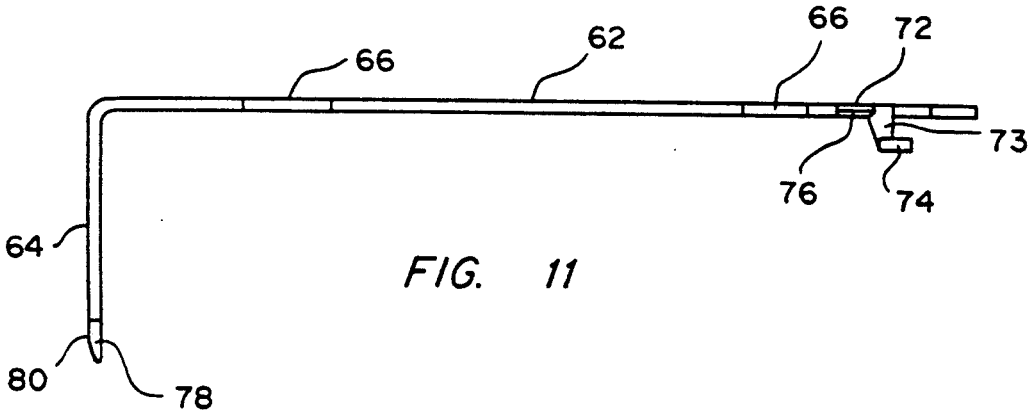
FIG. 11

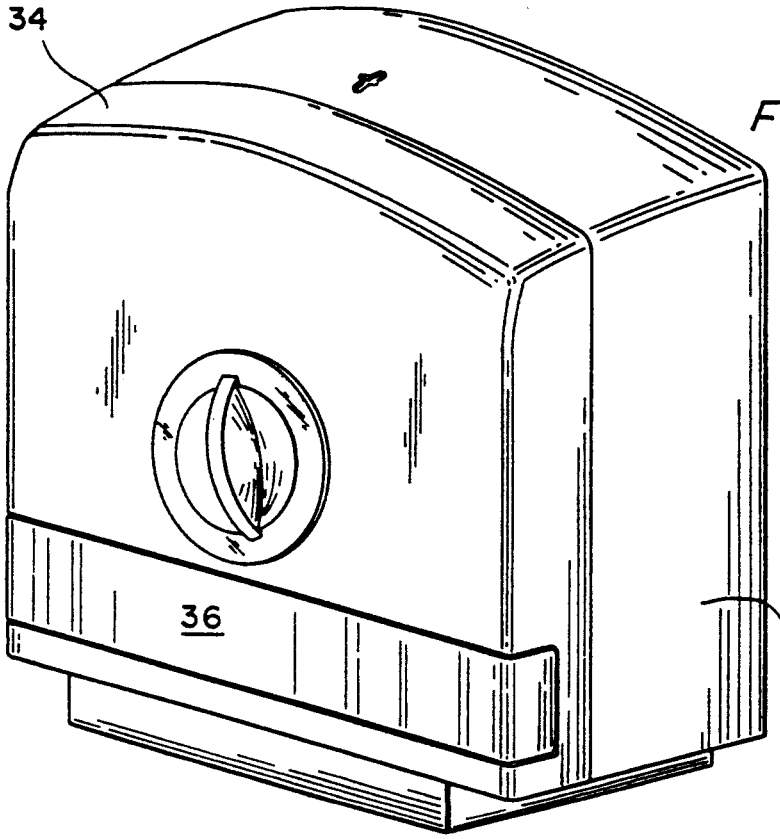
FIG. 18
FIG. 19
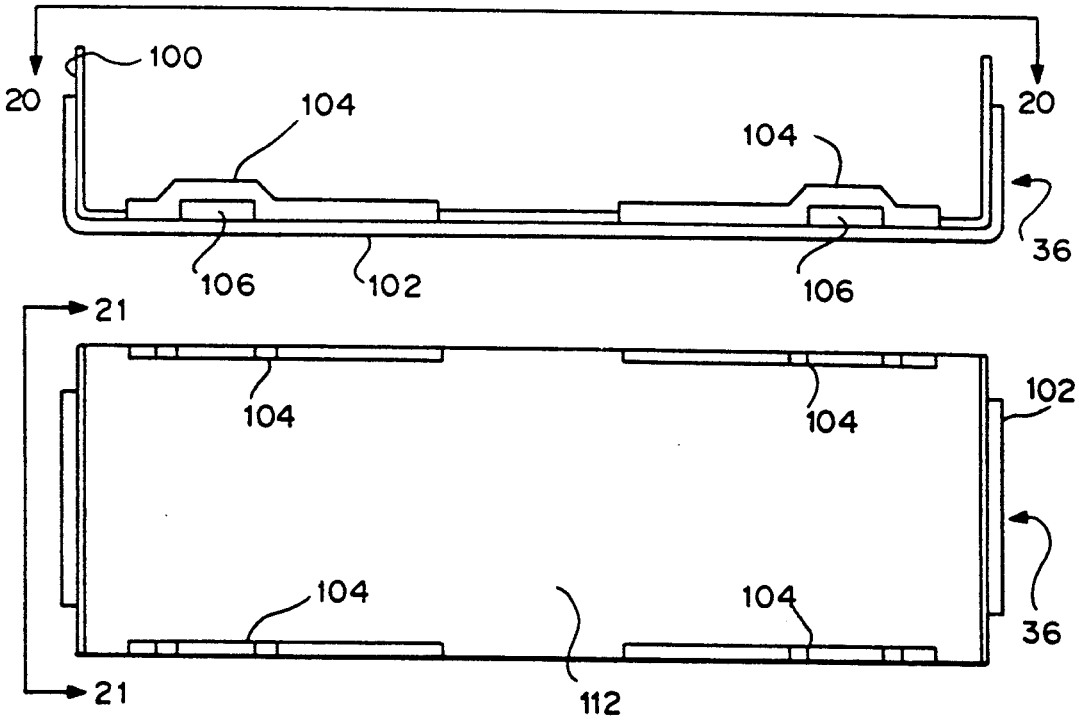
FIG. 20

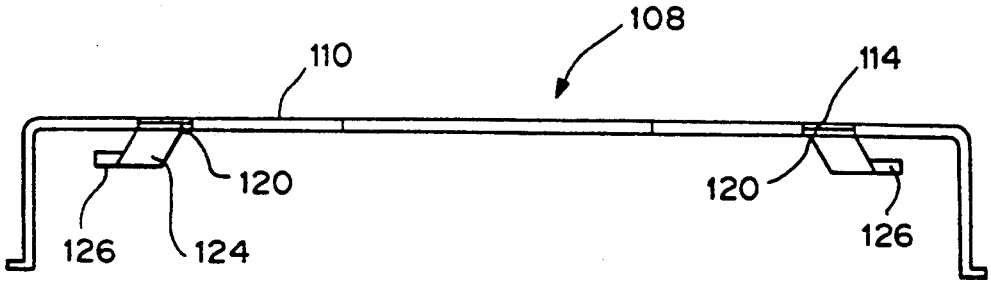
FIG. 23
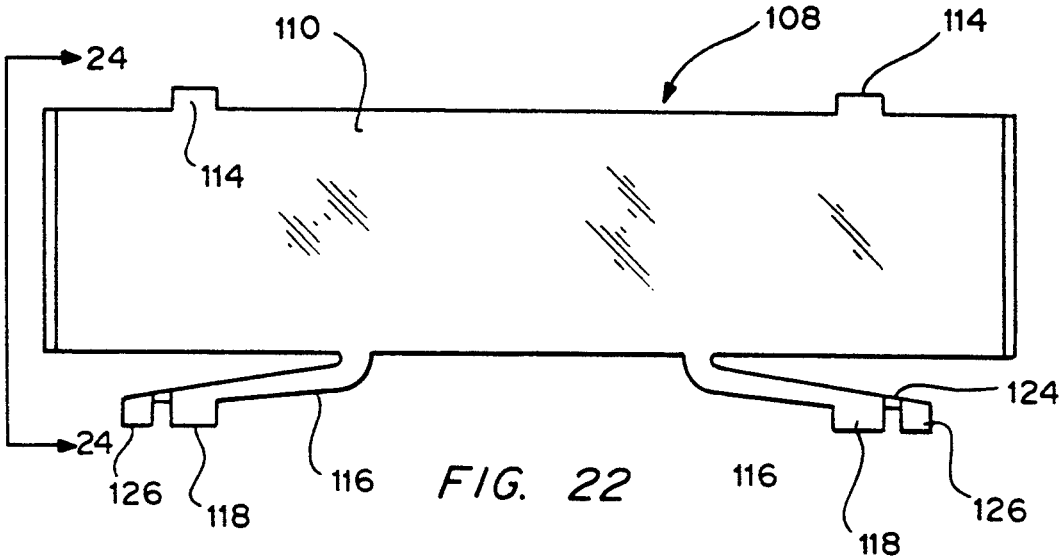
FIG. 22
FIG. 21
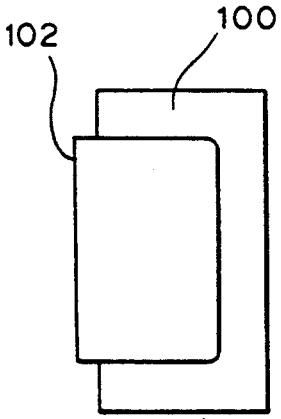
FIG. 24
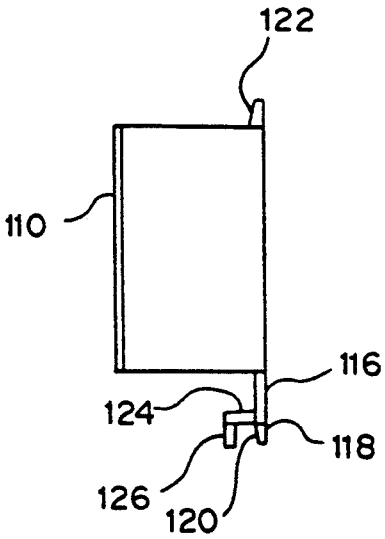

DECORATIVE WINDOW FOR PAPER AND SOAP PRODUCT DISPENSERS

BACKGROUND OF THE INVENTION

1. Field of the Invention

This invention relates generally to dispensers for dispensing liquid soaps and paper products such as paper towel and tissue and more particularly, to decorative windows for such dispensers to allow easy modification of such dispensers to match the decor of the room in which they are placed.

2. Brief description of the Prior Art

Many appliances and fixtures used in the home have long been adapted to received a variety of different color panels so as to match the decor of a particular room in the home. For example, dishwashers often come with a reversible front panel or with more than one panel such that one of two or more colors may be selected for the front of the appliance. Similarly, light switch covers made from a clear plastic are available such that the homeowner can line the inside of the switch cover with any particular color or a piece of wallpaper matching the room in which the switch cover is used.

Bastian U.S. Pat. No. 4,915,316 teaches a rolled towel holder wherein the end brackets are adapted to receive transparent covers. Each of the end brackets includes a recessed ridge for receiving a decorative insert to reside beneath the transparent covers.

Commercial dispensers for sanitary products are generally manufactured with a particularly sterile or antiseptic appearance. In an effort to make such dispensers more aesthetically appealing, some of such dispensers have been decorated by silk screening, embossing, affixing logos thereon, or hot stamping. Recently, such dispensers have been manufactured with a front cover or door which is clear, tinted, or semi-transparent.

Nothing in the prior art teaches commercial sanitary product dispensers (e.g., soap dispensers, paper towel dispensers, tissue dispensers, toilet seat cover dispensers, etc.) with windows mounted thereto which are adapted to interchangeably receive decorative strips. Further, in that public restrooms include a diversity of decors with a variety of different wall coverings, it is important that the ability to receive decorative strips is not limited to a particular thickness of strip. The present invention has no such limitation and further provides substantially planar support, front and back, to ensure that the decorating strip will not sag or wrinkle in the dispenser.

SUMMARY OF THE INVENTION

It is therefore an object of the present invention to provide a window apparatus for use with sanitary product dispensers which allow the dispenser to be fitted with a decorating strip to match the decor of the room in which they are mounted.

It is a further object of the present invention to provide a window apparatus for use in sanitary product dispensers which is easily adaptable to receive decorating strips of varying thicknesses.

Yet another object of the present invention to provide a window apparatus for use with sanitary product dispensers which does not detract from the dispenser's ability to substantially enclose and protect the product being dispensed.

Briefly stated the foregoing and numerous other objects, features and advantages of the present invention will become readily apparent upon reading of the detailed description, claims and drawings set forth herein. These objects, features and advantages are accomplished through the use of an outer window affixed to the face or front cover of the dispenser. A decorative strip support member is supplied which is engagable to and disengagable from the outer window. The support member is adapted to be received on the inside surface of the fixed outer window. The support member includes at least one flexible engaging arm extending therefrom for mating with support brackets extending from the outer window into the dispenser. Due to the flexibility of the support arms and further, as a result of the sloping surfaces of the latch bolts extending from the flexible support members, substantially planar decorating strips of a variety of thicknesses can be retained and supported between the outer window and the support member for full viewing through the outer window.

BRIEF DESCRIPTION OF THE DRAWINGS

FIG. 3 is a front elevational view of the outer window depicted in FIG. 3.

FIG. 4 is a end view taken along line 4—4 of FIG. 3.

FIG. 5 is a end view taken along line 5—5 of FIG. 3.

FIG. 6 is a top plan view of the outer window depicted in FIG. 2.

FIG. 7 is a sectional view taken along line 7—7 of FIG. 3.

FIG. 8 is a front elevational view of an inner support member to be used in conjunction with the outer window depicted in FIGS. 2 and 3.

FIG. 9 is a end view taken along line 9—9 of FIG. 8.

FIG. 10 is a end view taken along line 10—10 of FIG. 8.

FIG. 11 is a top plan view of the inner support member shown in FIG. 5.

FIG. 18 is a perspective view of a sanitary tissue dispenser equipped with the window apparatus of the present invention.

FIG. 19 is a top plan view of outer window of the type that would be used with the tissue dispenser depicted in FIG. 18.

FIG. 20 is a rear elevational view taken along line 20—20 of FIG. 19.

FIG. 21 is a end view of the outer window taken along line 21—21 of FIG. 20.

FIG. 22 is a front elevational view of an inner support member used in conjunction with the outer window depicted in FIGS. 19 through 21.

FIG. 23 is a bottom plan view of the inner support member depicted in FIG. 22.

FIG. 24 is a end view taken along line 24—24 of FIG. 22.

DETAILED DESCRIPTION OF THE PREFERRED EMBODIMENT

Figure 1:
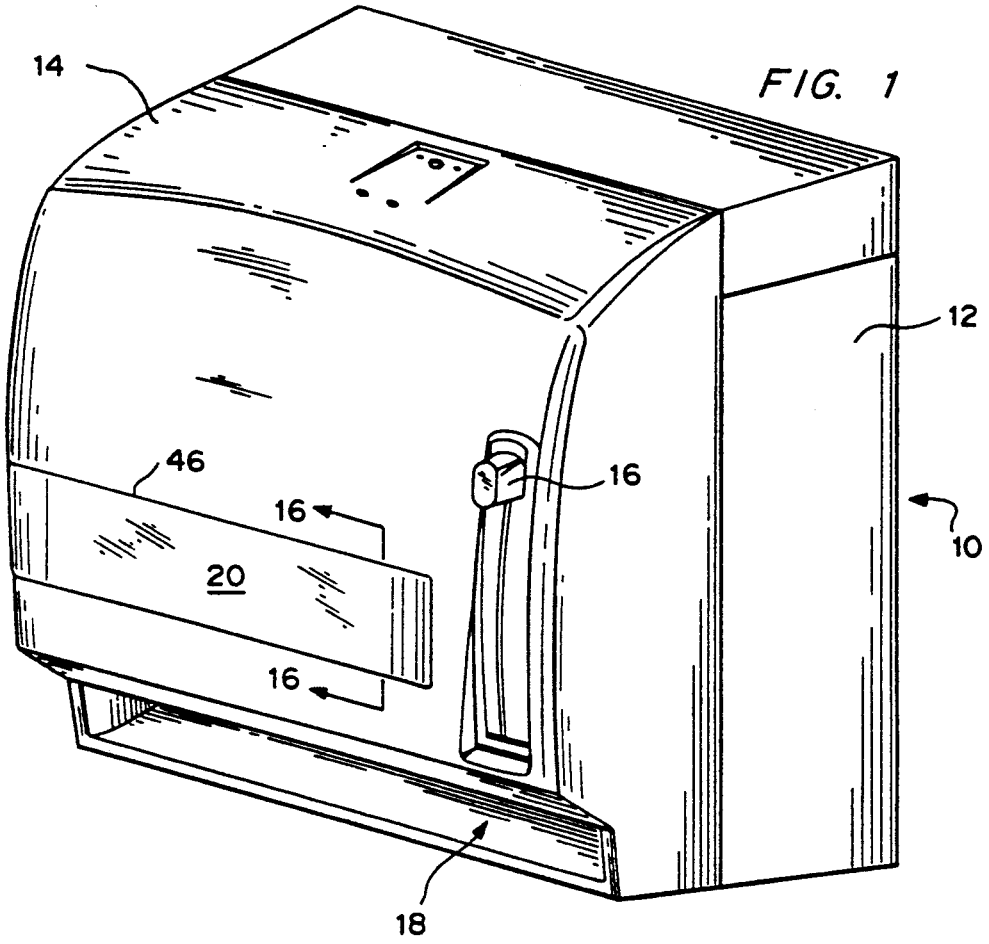
FIG. 1 is a perspective view of towel dispenser equipped with the window apparatus of the present invention.
Figure 2:
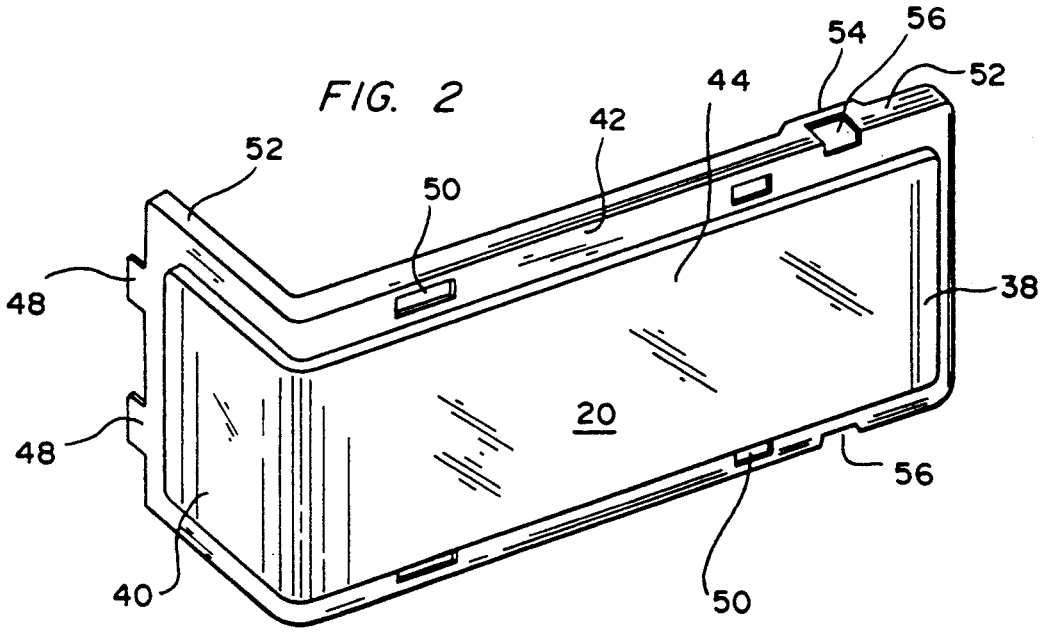
FIG. 2 is a perspective view of an outer window of the present invention for use with the towel dispenser depicted in FIG. 1.

Turning first to FIG. 1, there is shown a rolled towel dispenser 10 including a rear housing 12 and a front cover 14 pivotally connected to the rear housing 12. The dispenser includes a lever actuator 16 whereby a user can manually activate the drive mechanism within the dispenser to cause the tail of a roll of towel to exit through port 18. Mounted on cover 14 is outside or viewing window 20.

Looking next at FIGS. 2 through 7, there is depicted the outside window 20 of dispenser 10. Outside window 20 is preferably formed from a transparent plastic material to provide clear viewing of what lies there beneath. Window 20 is substantially L-shaped having a long end 38 and a short end 40. Long end 38 substantially crosses the front cover 14 of the dispenser 10 and short end 40 wraps partially out the side of dispenser 10. The lever mechanism 16 of the dispenser 10 prevents the window 20 from extending totally across the face or cover 14 of dispenser 10.

Window 20 includes a peripheral ledge 42 which abuts and is affixed to the inside face of front cover 14. Outside window 20 further includes a raised lens portion 44. When window 20 is mounted within cover 14 such that peripheral ledge 42 abuts inside face of cover 14, raise lens portion 44 extends through opening 46 in cover 14 such that the outside planar surface of raised lens portion 44 becomes substantially co-planar with the outside surface of cover section 14.

Extending from the short end 40 of outside window 20 are guide tabs 48. There are a plurality of alignment ports 50 disposed in peripheral ledge 42. Extending back from peripheral edge 42 is shelf 52. Formed integrally with shelf 52 are latch brackets 54 having latch bolt openings 56 therethrough.

Figure 12:
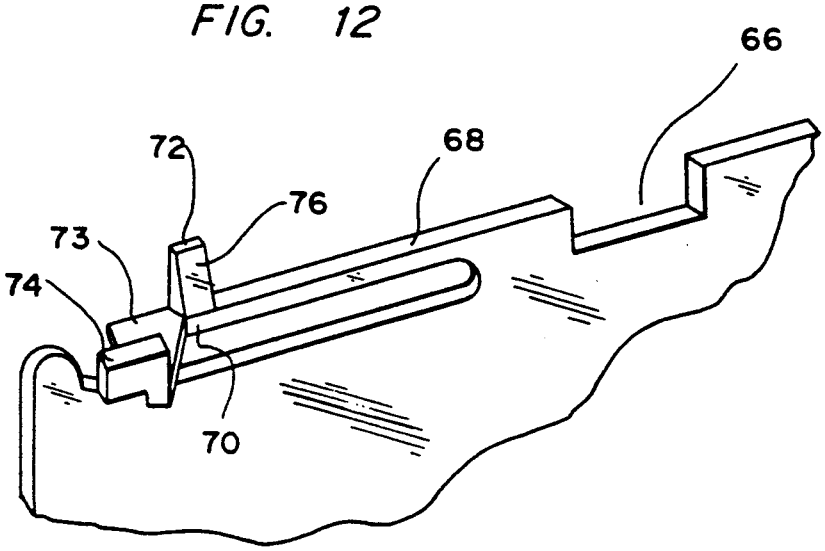
FIG. 12 is an enlarged perspective view detail of the flexible arm of the support member depicted in FIG. 5.
Figure 13:
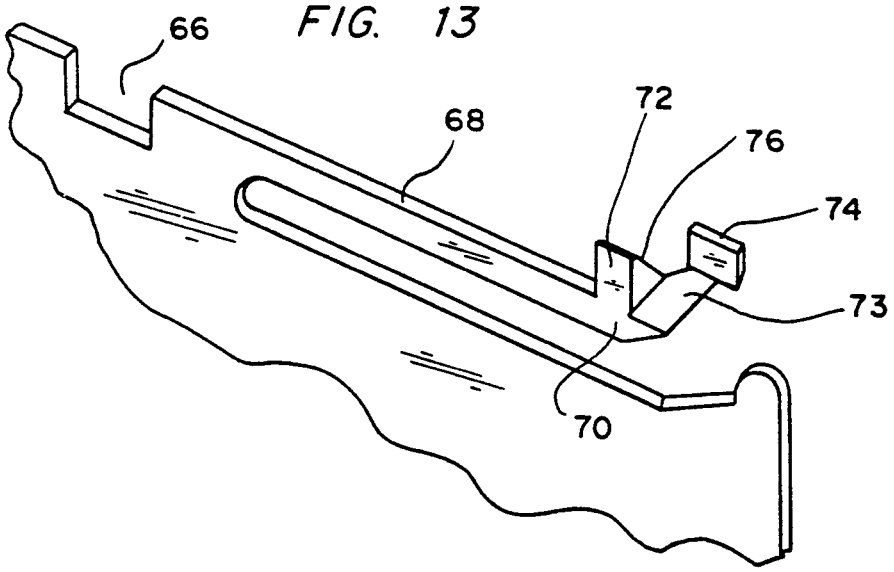
FIG. 13 is a reverse angle perspective view of that which is depicted in FIG. 12.
Figure 14:
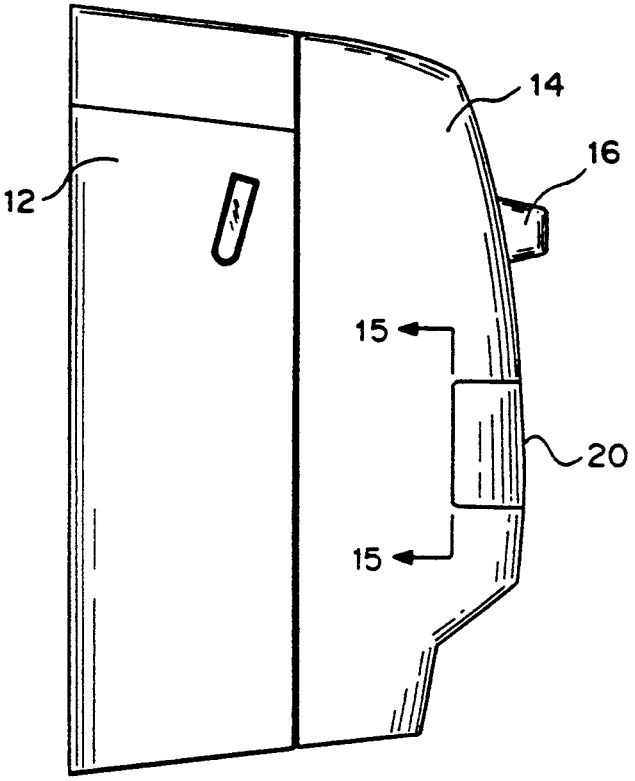
FIG. 14 is a side elevational view of the towel dispenser depicted in FIG. 1.

Looking next at FIGS. 8 through 11, there is shown the inside or decorative strip support member 60 of the present invention to be used in conjunction with the outside window 20 depicted in FIGS. 2 through 7. Inside support member 60 is also L-shaped having a long end 62 and a short end 64. Disposed in the periphery of long end 62 are a plurality of cutouts 66. Cutouts 66 align with alignment ports 50 when inside support members 60 is mounted to the inside surface of outside window 20. Formed integrally with decorative strip support member 60 are latch bars 68. Each latch bar 68 includes a distal end 70 which is free or cantilevered. Latch bars 68 are shown in FIGS. 12 and 13 in enlarged perspective views. Extending from each latch bar 68 in a direction away from inside support member 60 is latch bolt 72. Latch bars 68 and latch bolts 72 are preferably substantially co-planar with long end 62 of support member 60. Extending from the distal end 70 of each latch bar 68 is an access arm 73 having an tab 74 projecting therefrom. Each latch bolt 72 includes a sloping surface 76. Extending from the short end 64 of inside support member 60 is tab 78. Guide tab 78 includes a sloping surface 80 such that tab 78 tapers the further it extends from short end 64.

Latch bar 68, latch bolt 72 and latch bolt receptable or opening 56 serve as connecting or latching means to connect decorative strip support member 60 to window 20. It should be recognized that the connecting means can be reversed such that the latch bar and latch bolt could be integrally formed with or affixed to window 20 and latch bolt opening 56 could be in decorative strip support member 60.

Figure 15:
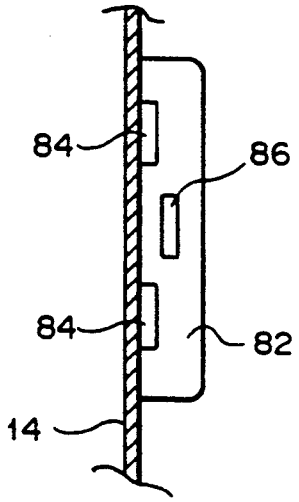
FIG. 15 is a partial sectional view taken along line 15—15 of FIG. 19.

Looking next at FIG. 15 there is shown a support bracket 82 extending from the inside surface of cover 14. Support bracket 82 includes receptacles 84 adapted to receive guide tabs 48 of outside window 20. Support bracket 82 further includes receptacle 86 adapted to receive guide tab 78 of inside support member 60.

Figure 16:
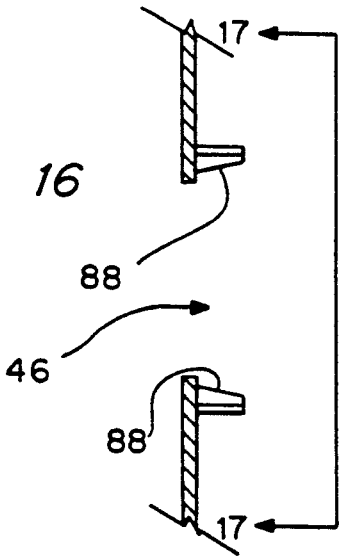
FIG. 16 is a partial sectional view taken along line 16—16 of FIG. 1 with the window and support member removed.
Figure 17:
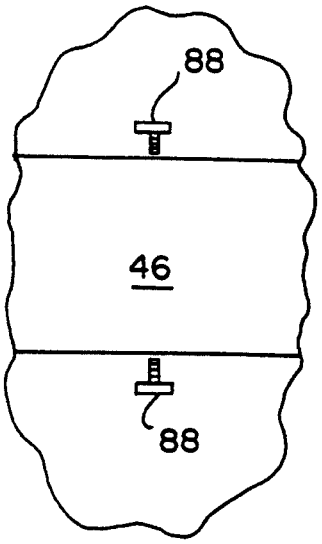
FIG. 17 is a partial rear elevational view taken along line 17—17 of FIG. 16.

Also extending from the inside surface of front cover 14 are a plurality of guide posts 88 (see FIGS. 16 and 17). Guide posts 88, in combination with alignment ports 50, allow for the easy alignment of outside window 20 in opening 46 of front cover 14. Guide posts 88 may be used strictly as guide means. Further, guide posts 88 may alternatively be used as means for locking outside window 20 onto cover 14. Further, guide posts 88 can take the form of bolts or screws. In such manner, guide posts 88 can simultaneously serve as connecting or latching means for connecting window 20 or cover 14 to decorative strip support member 60. Preferably, however, window 20 is attached to the inside surface of cover 14 by means of ultrasonic welding, heat welding or gluing of the peripheral ledge 42 to the inside surface of cover 14. If the entire peripheral ledge 42 is thereby sealed to the inside cover, the connection becomes substantially liquid tight. In such manner, when an attendant has cause to clean the outside surface of the dispenser 10, the cleaning solvent and any other liquid will not pass through the seam between the cover 14 and the outside window 20 preventing potential contamination of the decorative strip or the towel product within the dispenser 10.

In order to place a decorative strip between outside or viewing window 20 and support member 60, it is first necessary to open the dispenser 10 by pivoting cover 14 downward away from rear housing 12. Inside support member 60 can then be removed from outside window 20 by grasping both access tabs 74 and pushing them toward one another thereby flexing latch bars 68 to the extent that latch bolts 72 clear latch bolt openings 56. The long end 62 of inside support member 60 can then be pivoted away from the long end 38 of outside window 20. As the decorative strip support member 60 is so pivoted, guide tab 78 withdraws from receptacle 86 allowing for the complete removal of the inside support member 60. A decorative strip may then be cut in the appropriate shape and size, perhaps matching the wallpaper used in the room where the dispenser has been mounted. The decorative strip is pressed against the inside surface of outside window 20. Inside support member 60 is then replaced such that tab 78 extends through receptacle 86 and latch bolts 72 extend through latch bolt openings 56. In such manner, the decorative strip is substantially fully supported by planar surfaces front and back to maintain the strip in an optimum viewing position without wrinkling or sagging. The decorative strip can thus be changed as often as needed or desired depending on the decor of the restroom.

Looking next at FIG. 18 there is shown a sanitary tissue dispenser 30 which includes a rear housing 32 and a front cover section 34 pivotally attached to there rear housing 32. Mounted in front cover 34 is outside window 36. Tissue dispenser 30 is more fully described in U.S. patent application Ser. No. 07/922,445 which is hereby incorporated herein by reference.

Turning next to FIGS. 19, 20 and 21 there is shown an alternative embodiment outside window 36 adapted for use with the tissue dispenser 30 depicted in FIG. 18. This alternative embodiment outside window 36 is symmetrical and is, therefore U-shaped instead of L-shaped. In such manner, outside window 36 expands completely across the front of front cover 34 and partially wraps about the sides of front cover 34. Outside window 36 includes a peripheral ledge 100. Extending outward from peripheral ledge 100 and formed integrally therewith is a raised lens portion 102. Extending back from the inside surface of outside or viewing window 36 are a plurality of support brackets 104. Disposed in each support bracket 104 is a receptacle or latch bolt opening 106.

FIGS. 22, 23 and 24 depict the inside support member 108 to be used in conjunction with the outside window depicted in FIGS. 19 through 21. Inside support member 108 is also U-shaped and sized to fit within outside window 36 such that outside surface 110 of inside support member 108 substantially abuts inside surface 112 of outside window 36. Extending from inside support member 108 are tabs 114. Also extending from inside support member 108 are latch bars 116. Latch bars 116 each have a latch bolt 118 extending therefrom. Each latch bolt 118 includes a sloping surface 120. Similarly, each tab 114 includes a sloping surface 122. There is an arm member 124 extending back from each latch bar 116. Extending from each arm member 124 is an access tab 126.

As was the case with the embodiment of the present invention described in connection with the towel dispenser 10, inside support member 108 is only accessible by opening tissue dispenser 30. Once again, by cutting an appropriate decorative strip, the user need only grasp access tabs 126 and press downward or toward the main body of inside or decorative strip support member 108. Latch bars 116 are thus flexed downwardly allowing latch bolts 118 to pass beyond latch bolt openings or receptacles 106. The inside support member 108 can then be pivoted to clear latch bolt 118 from support brackets 104. The inside support member 108 is actually being pivoted about tabs 114 which reside in latch bolt openings or receptacles 106 on the opposite side of outside window 36. Once pivoted, the inside support member 106 may be removed completely from outside window 36. The decorative strip may then be placed against inside surface 112 of outside window 36 and inside support member 108 may be replaced in its locked position supporting the decorative strip between inside support member 108 and outside window 36. Because inside support member 108 is integrally formed of a somewhat flexible plastic material, latch bars 116 are naturally spring biased to a locked position with latch bolt 118 residing in latch bolt openings 106. The method of attachment of outside window 36 to the inside surface of tissue dispenser 30 is substantially identical to that described with regard to outside window 20 and tissue dispenser 10. However, it should be noted that in connection with the embodiment described with tissue dispenser 30, there are no guide posts 88 used as were used with towel dispenser 10. Although guide posts 88 are a preferred means of aligning outside window 20 in towel dispenser 10, they are not required.

It should be appreciated that because latch bars 68 and 116 are flexible, they are capable of flexing not only in the direction which allows them to engage and disengage latch bolt openings 56 and 106, but also flexible, perpendicular to that direction, that is, perpendicular to the plane of the long end 62 of support member 60. It is the flexibility in such direction that allows the decorative strip support members 60 and 108 to automatically compensate for decorative strips of different thicknesses. This ability is further enhanced by sloping surfaces 76, 80, 120 and 122.

From the foregoing, it would be seen that this invention is one well adapted to attain all of the ends and objects herein above set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth were shown in the accompanying drawings are to interpreted as illustrative and not in a limiting sense.

What is claimed is:

1. A sanitary product dispenser including a decorative window apparatus comprising:

a. a rear housing;

b. a front cover pivotally connected to said rear housing, said rear housing and said cover forming a compartment for containing a sanitary product;

c. an opening in said front cover;

d. a window mounted in said opening, said window being substantially transparent;

e. a support member residing within the sanitary product dispenser;

f. connecting means for connecting said support member to said front cover to thereby allow a decorative strip to be pressed and supported therebetween, said connecting means automatically compensating for decorative strips of different thicknesses.

2. A decorative window apparatus for use with a sanitary product dispenser having an opening in the front cover thereof, said decorative window apparatus comprising:

a. a substantially transparent window means adapted to be mounted in an opening of a sanitary product dispenser, said transparent window means including at least one latch bolt receptacle therein;

b. an inside support member including flexible latch bar means extending therefrom, said flexible latch bar means engagable with said latch bolt receptacle to allow said inside support member to be maintained immediately adjacent said window means to thereby allow a substantially planar decorative strip to be supported and pressed therebetween, said latch bar means automatically compensating for decorative strips of different thicknesses.

3. A decorative window apparatus for use with a sanitary product dispenser as recited in claim 2 further comprising:

latch bolt means extending from said latch bar means, said latch bolt means residing in said latch bolt receptacle when said inside support member is mounted to said transparent window means, said latch bolt means including at least one sloping surface thereby allowing said latch bolt means to engage said latch bolt receptacle while being only partially inserted therein.

4. A decorative window apparatus for use with a sanitary product dispenser as recited in claim 2 further comprising:

a peripheral ledge extending from and integrally formed with said window means, said peripheral ledge being affixed to an inside surface of the front cover surrounding the opening therein.

5. A decorative window apparatus for use with a sanitary product dispenser as recited in claim 2 wherein:

said window means includes a raised lens portion which extends into the opening in the front cover.

6. A decorative window apparatus for use with a sanitary product dispenser as recited in claim 2 wherein:

said latch bar means includes a free distal end with access tab means extending therefrom for grasping by a user, said access tab means thereby allowing said flexible latch bar means to be easily flexed.

7. A decorative window apparatus for use with a sanitary product dispenser as recited in claim 4 further comprising:

at least one latch bracket extending from said peripheral ledge, said latch bolt receptacle being formed in said latch bracket.

8. A sanitary product dispenser including a decorative window apparatus comprising:

a. a rear housing;

b. a front cover pivotally connected to said rear housing, said rear housing and said cover forming a compartment for containing a sanitary product;

c. an opening in said front cover;

d. an outside window mounted in said opening, said outside window being substantially transparent;

e. an inside support member including flexible latch bar means extending therefrom, said flexible latch bar means engagable with said latch bolt receptacle to allow said inside support member to be maintained immediately adjacent said window means to thereby allow a decorative strip to be supported therebetween, said decorative strip including a substantially planar first surface and a substantially planar second surface, said latch bar means automatically compensating for decorative strips of different thicknesses such that said first surface is abutted by said outside window and said second surface is abutted by said inside support member.

9. A decorative window apparatus for use with a sanitary product dispenser having an opening in the front cover thereof, said decorative window apparatus comprising:

a. a substantially transparent window means adapted to be mounted in an opening of a sanitary product dispenser, said transparent window means including at least one latch bolt receptacle therein;

b. a decorative strip support member;

c. connecting means for connecting said support member to said window to thereby allow a decorative strip to be pressed and supported therebetween, said connecting means automatically compensating for decorative strips of different thicknesses.

10. A sanitary product dispenser including a decorative window apparatus as recited in claim 1 wherein:

said window includes at least one latch bolt receptacle therein and said connecting means includes a flexible latch bar extending from said support member, said flexible latch bar engagable with said latch bolt receptacle.

11. A sanitary product dispenser including a decorative window apparatus as recited in claim 10 further comprising:

a latch bolt extending from said latch bar, said latch bolt residing in said latch bolt receptacle when said support member is mounted to said window, said latch bolt including at least one sloping surface thereby allowing said latch bolt to engage said latch bolt receptacle while being only partially inserted therein.

12. A sanitary product dispenser including a decorative window apparatus as recited in claim 1 further comprising:

a peripheral ledge extending from and integrally formed with said window, said peripheral ledge being affixed to an inside surface of the front cover surrounding the opening therein.

13. A sanitary product dispenser including a decorative window apparatus as recited in claim 1 wherein:

said window includes a raised lens portion which extends into the opening in the front cover.

14. A sanitary product dispenser including a decorative window apparatus as recited in claim 1 wherein:

said latch bar includes a free distal end with access tab means extending therefrom for grasping by a user, said access tab means thereby allowing said flexible latch bar to be easily flexed.

15. A sanitary product dispenser including a decorative window apparatus as recited in claim 12 further comprising:

at least one latch bracket extending from said peripheral ledge, said latch bolt receptacle being formed in said latch bracket.

16. A decorative window apparatus for use with a sanitary product dispenser as recited in claim 2 further comprising:

guide tab means extending from an edge of said inside support member, said guide tab means adapted to be inserted into a slotted guide bracket, said guide tab means including a sloped surface, said sloped surface of said guide tab means being located on that side of said guide tab means furthest from said outside window means.

17. A decorative window apparatus for use with a sanitary product dispenser as recited in claim 9 wherein:

said connecting means includes at least one latch bolt receptacle in said window means and at least one flexible latch bar means extending from said decorative strip support member, said flexible latch bar means engagable with said latch bolt receptacle to allow said inside support member to be maintained immediately adjacent said window means to thereby allow a decorative strip to be supported therebetween, said decorative strip including a substantially planar first surface and a substantially planar second surface, said latch bar means automatically compensating for decorative strips of different thicknesses such that said first surface is abutted by said outside window and said second surface is abutted by said inside support member.

18. A sanitary product dispenser including a decorative window apparatus as recited in claim 1 wherein:

said connecting means connects said support member to said window mounted in said front cover.

* * * * *